US009093026B2

(12) United States Patent
Woo

(10) Patent No.: US 9,093,026 B2
(45) Date of Patent: Jul. 28, 2015

(54) PIXEL AND ORGANIC LIGHT EMITTING DISPLAY USING THE SAME

(71) Applicant: Samsung Display Co., Ltd., Yongin, Gyeonggi-do (KR)

(72) Inventor: Min-Kyu Woo, Yongin (KR)

(73) Assignee: Samsung Display Co., Ltd., Gyeonggi-do (KR)

( * ) Notice: Subject to any disclaimer, the term of this patent is extended or adjusted under 35 U.S.C. 154(b) by 265 days.

(21) Appl. No.: 13/665,509

(22) Filed: Oct. 31, 2012

(65) Prior Publication Data

US 2014/0028647 A1 Jan. 30, 2014

(30) Foreign Application Priority Data

Jul. 26, 2012 (KR) ..... 10-2012-0081870

(51) Int. Cl.
*G09G 3/30* (2006.01)
*G09G 3/32* (2006.01)

(52) U.S. Cl.
CPC ..... *G09G 3/3233* (2013.01); *G09G 2300/0819* (2013.01); *G09G 2300/0852* (2013.01); *G09G 2300/0861* (2013.01); *G09G 2320/043* (2013.01)

(58) Field of Classification Search
CPC ..... G09G 3/30
USPC ..... 345/76, 82, 690, 204, 211
See application file for complete search history.

(56) References Cited

U.S. PATENT DOCUMENTS

| | | | | |
|---|---|---|---|---|
| 2006/0066532 | A1* | 3/2006 | Jeong | 345/76 |
| 2008/0211397 | A1* | 9/2008 | Choi | 313/504 |
| 2010/0253608 | A1* | 10/2010 | Kim et al. | 345/76 |
| 2011/0109660 | A1 | 5/2011 | Kim | |
| 2011/0193850 | A1* | 8/2011 | Chung et al. | 345/212 |
| 2012/0019498 | A1 | 1/2012 | Jeong | |
| 2012/0026146 | A1* | 2/2012 | Kim | 345/211 |

FOREIGN PATENT DOCUMENTS

| | | | |
|---|---|---|---|
| KR | 10-2005-0052033 | A | 6/2005 |
| KR | 10-1034738 | B1 | 5/2011 |
| KR | 10-2012-0009904 | A | 2/2012 |

* cited by examiner

*Primary Examiner* — Pegeman Karimi
(74) *Attorney, Agent, or Firm* — Knobbe, Martens, Olson & Bear, LLP

(57) ABSTRACT

A pixel capable of stably compensating for the threshold voltage of a driving transistor is disclosed. In one aspect, the pixel includes an organic light emitting diode (OLED), a first transistor for controlling an amount of current supplied from a first power supply coupled to a second node to the OLED to correspond to a voltage applied to a third node, and a second transistor coupled between the second node and a first node and turned on when a control signal is supplied to a control line. The pixel also includes a third transistor coupled between the third node and a reference power supply and turned on when the control signal is supplied, a first capacitor coupled between the first node and the first power supply, and a second capacitor coupled between the first node and the third node.

14 Claims, 3 Drawing Sheets

PIXEL AND ORGANIC LIGHT EMITTING DISPLAY USING THE SAME

CROSS-REFERENCE TO RELATED APPLICATION

This application claims priority to and the benefit of Korean Patent Application No. 10-2012-0081870, filed on Jul. 26, 2012, in the Korean Intellectual Property Office, the entire content of which is incorporated herein by reference.

BACKGROUND

1. Field

The described technology generally relates to a pixel and an organic light emitting display using the same, and more particularly, to a pixel capable of stably compensating for a threshold voltage and an organic light emitting display using the same.

2. Description of the Related Technology

Recently, various flat panel displays (FPD) capable of reducing weight and volume have been developed. FPDs include liquid crystal displays (LCD), field emission displays (FED), plasma display panels (PDP), and organic light emitting displays.

An organic light emitting displays display images using organic light emitting diodes (OLED) that generate light by re-combination of electrons and holes. The organic light emitting display has high response speed and is driven with low power consumption.

The organic light emitting display includes a plurality of pixels arranged at intersections of a plurality of data lines, scan lines, and power supply lines in a matrix. Each of the pixels commonly includes an organic light emitting diode (OLED), at least two transistors including a driving transistor, and at least one capacitor.

SUMMARY

One inventive aspect is a pixel capable of stably compensating for a threshold voltage and an organic light emitting display using the same.

Another aspect is a pixel, including an organic light emitting diode (OLED), a first transistor for controlling an amount of current supplied from a first power supply coupled to a second node to the OLED to correspond to a voltage applied to a third node, a second transistor coupled between the second node and a first node and turned on when a control signal is supplied to a control line, a third transistor coupled between the third node and a reference power supply and turned on when the control signal is supplied, a first capacitor coupled between the first node and the first power supply, and a second capacitor coupled between the first node and the third node.

The pixel further includes a fourth transistor coupled between an anode electrode of the OLED and the reference power supply and turned on when the control signal is supplied and a fifth transistor coupled between a data line and the first node and turned on when a scan signal is supplied to a scan line. The reference power supply is set as a lower voltage than a data signal supplied to the data line. The reference power supply is set as a voltage at which the OLED may be turned off when the fourth transistor is turned on. The turn on period of the fourth transistor does not overlap the turn on period of the fifth transistor. The pixel further includes a sixth transistor coupled between the first power supply and the second node and turned off when an emission control signal is supplied to an emission control line. The turn on period of the sixth transistor does not overlap the turn on period of the fourth transistor and the turn on period of the fifth transistor.

Another aspect is an organic light emitting display, including a scan driver for supplying scan signals to scan lines and for supplying emission control signals to emission control lines, a control line driver for supplying control signals to control lines, a data driver for supplying data signals to data lines, and pixels positioned at intersections of the scan lines and the data lines. Each of the pixels positioned in an ith (i is a natural number) horizontal line includes an OLED, a first transistor for controlling an amount of current supplied from a first power supply coupled to a second node to the OLED to correspond to a voltage applied to a third node, a second transistor coupled between the second node and a first node and turned on when a control signal is supplied to a control line, a third transistor coupled between the third node and a reference power supply and turned on when the control signal is supplied, a first capacitor coupled between the first node and the first power supply, and a second capacitor coupled between the first node and the third node.

The control line driver supplies a control signal to the ith control line before a scan signal is supplied to an ith scan line. The scan driver supplies an emission control signal to an ith emission control line to overlap the scan signal supplied to the ith scan line and the control signal supplied to the ith control line. The control signal is set to have width equal to or larger than width of the scan signal. The reference power supply is set to have a lower voltage than the data signal. The organic light emitting display further includes a fourth transistor coupled between an anode electrode of the OLED and the reference power supply and turned on when the control signal is supplied to the ith control line and a fifth transistor coupled between a data line and the first node and turned on when the scan signal is supplied to the ith scan line. The reference power supply is set to have a voltage t which the OLED may be turned off when the fourth transistor is turned on. The organic light emitting display further includes a sixth transistor coupled between the first power supply and the second node and turned off when the emission control signal is supplied to the ith emission control line.

DETAILED DESCRIPTION

Figure 1:
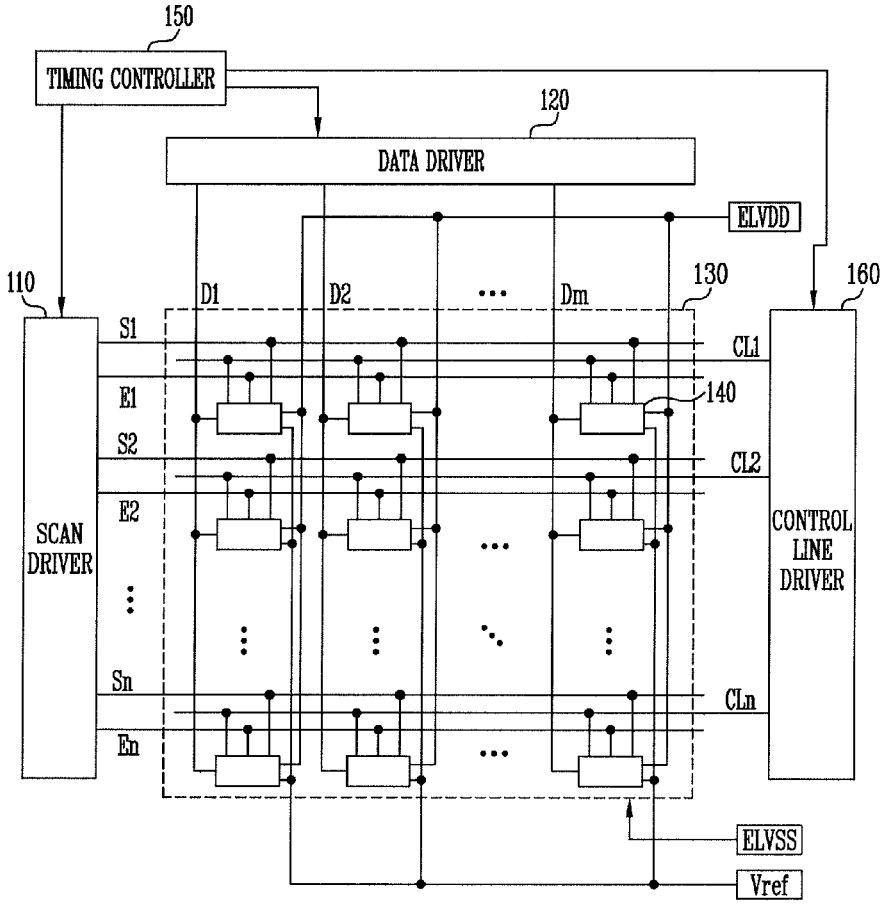
FIG. 1 is a view illustrating an organic light emitting display according to an embodiment.

An organic light emitting display consumes a small amount of power. However, an amount of current that flows to organic light emitting diodes (OLED) changes in accordance with a deviation in the threshold voltages of the driving transistors included in the pixels so that non-uniformity in display is caused. That is, the characteristics of the driving transistors change in accordance with the manufacturing process variables of the driving transistors included in the pixels. It is generally very difficult to manufacture all of the transistors of the organic light emitting display to have the same characteristic in current processes. Therefore, a deviation in the threshold voltages of the driving transistors is frequently generated.

In order to solve the problem, a method of adding a compensating circuit formed of a plurality of transistors and a capacitor to each of the pixels has been proposed. The compensating circuits couple the driving transistors in the form of a diode in a period where scan signals are supplied to compensate for the deviation in the threshold voltages of the driving transistors.

On the other hand, recently, a method of driving a panel at high resolution and/or high driving frequency in order to improve picture quality has been proposed. However, when the panel is driven at high resolution and/or high driving frequency, supply time of the scan signals is reduced so that it is difficult to compensate for the threshold voltages of the driving transistors.

Hereinafter, embodiments will be described with reference to the accompanying drawings. Here, when a first element is described as being coupled to a second element, the first element may be not only directly coupled to the second element but may also be indirectly coupled to the second element via a third element. Further, some of the elements that are not essential to the complete understanding of the present disclosure are omitted for clarity. Also, like reference numerals refer to like elements throughout.

Hereinafter, a pixel and an organic light emitting display using the same will be described in detail as follows with reference to FIGS. 1 to 5.

FIG. 1 is a view illustrating an organic light emitting display according to an embodiment.

Referring to FIG. 1, the organic light emitting display includes a pixel unit 130 including pixels 140 positioned at the intersections of scan lines S1 to Sn, emission control lines E1 to En, control lines CL1 to CLn, and data lines D1 to Dm, a scan driver 110 for driving the scan lines S1 to Sn and emission control lines E1 to En, a data driver 120 for driving the data lines D1 to Dm, a control line driver 160 for driving control lines CL1 to CLn, and a timing controller 150 for controlling the scan driver 110, the data driver 120, and the control line driver 160.

The control line driver 160 sequentially supplies control signals to the control lines CL1 to CLn. Here, the control signal supplied to the ith (i is a natural number) control line does not overlap with the scan signal supplied to the ith scan line S1. Actually, the control signal supplied to the ith control line CLi is supplied before the scan signal is supplied to the ith scan line S1. In a period where the control signals are supplied, the pixels 140 charge voltages corresponding to the threshold voltages of driving transistors. In one embodiment, the width of the control signals is set to be substantially the same as or larger than the width of the scan signals so that the threshold voltages may be stably charged in the pixels 140.

The scan driver 110 sequentially supplies the scan signals to the scan lines S1 to Sn and sequentially supplies emission control signals to the emission control lines E1 to En. Here, the emission control signal supplied to the ith emission control line Ei overlaps with the scan signal supplied to the ith scan line S1 and the control signal supplied to the ith control line CLi. On the other hand, the control signals and the scan signals are set as voltages at which the transistors included in the pixels 140 may be turned on and the emission control signals are set as voltages at which the transistors included in the pixels 140 may be turned off.

The data driver 120 supplies data signals to the data lines D1 to Dm in synchronization with the scan signals.

The timing controller 150 controls the scan driver 110, the data driver 120, and the control line driver 160 to correspond to synchronizing signals supplied from the outside of the organic light emitting display.

The pixel unit 130 includes the pixels 140 formed at the intersections of the scan lines S1 to Sn and the data lines D1 to Dm. In one embodiment, the pixels 140 receive a first power supply ELVDD, a second power supply ELVSS, and a reference power supply Vref from the outside of the organic light emitting display. The first power supply ELVDD is set as a higher voltage than the second power supply ELVSS. The reference power supply Vref is set as a lower voltage than the data signals. The pixels 140 that receive the first power supply ELVDD, the second power supply ELVSS, and the reference power supply Vref control the amounts of currents that flow from the first power supply ELVDD to the second power supply ELVSS via organic light emitting diodes (OLED) to correspond to the data signals.

Figure 2:
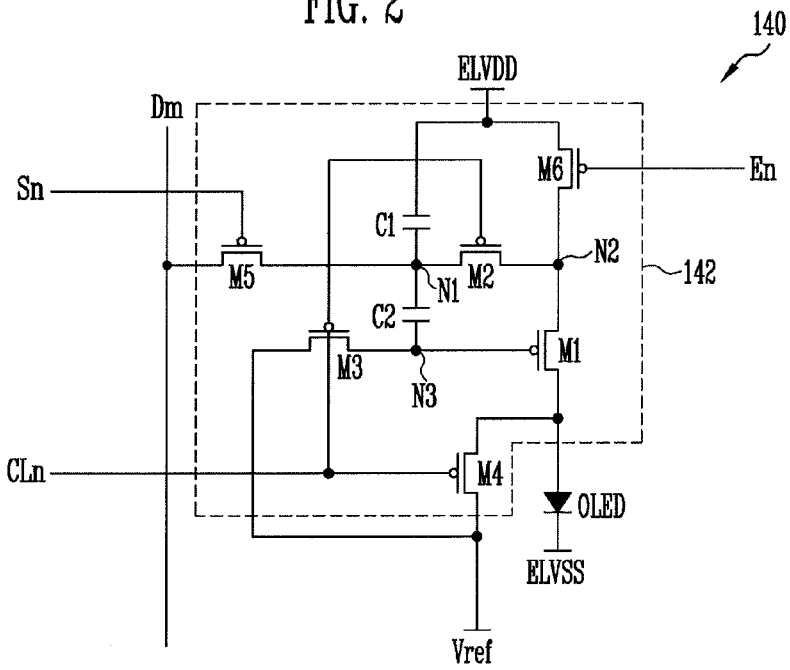
FIG. 2 is a view illustrating a pixel according to an embodiment.

FIG. 2 is a view illustrating a pixel according to one embodiment. In FIG. 2, for convenience sake, the pixel coupled to nth scan line Sn and the mth data line Dm will be illustrated.

Referring to FIG. 2, the pixel 140 includes an organic light emitting diode (OLED) and a pixel circuit 142 for controlling the amount of current supplied to the OLED.

The anode electrode of the OLED generates light with predetermined brightness to correspond to the amount of current supplied from the pixel circuit 142. For example, the OLED generates red, green, or blue light with predetermined brightness to correspond to the amount of current supplied from the pixel circuit 142.

The pixel circuit 142 compensates for the threshold voltage of a first transistor M1 (a driving transistor) in a period where the control signal is supplied to the control line CLn and charges a voltage corresponding to the data signal in a period where the scan signal is supplied to the scan line Sn. In a period where the emission control signal is not supplied to the emission control line En, the pixel circuit 142 supplies the current corresponding to the data signal to the OLED. Therefore, the pixel circuit 142 includes a first transistor M1 to a sixth transistor M6, a first capacitor C1, and a second capacitor C2.

The first electrode of the first transistor M1 is coupled to a second node N2 and the gate electrode of the first transistor M1 is coupled to a third node N3. The second electrode of the first transistor M1 is coupled to the anode electrode of the OLED. The first transistor M1 controls the amount of current supplied to the OLED to correspond to a voltage applied to the third node N3.

The second transistor M2 is coupled between the first node N1 and the second node N2. The gate electrode of the second transistor M2 is coupled to the control line CLn. The second transistor M2 is turned on when the control signal is supplied to the control line CLn to electrically couple the first node N1 and the second node N2 to each other.

The third transistor M3 is coupled between the reference power supply Vref and the third node N3. The gate electrode of the third transistor M3 is coupled to the control line CLn. The third transistor M3 is turned on when the control signal is supplied to the control line CLn to supply the voltage of the reference power supply Vref to the third node N3.

The fourth transistor M4 is coupled between the anode electrode of the OLED and the reference power supply Vref. The gate electrode of the fourth transistor M4 is coupled to the control line CLn. The fourth transistor M4 is turned on when the control signal is supplied to the control line CLn to supply the voltage of the reference power supply Vref to the anode electrode of the OLED.

The fifth transistor M5 is coupled between the data line Dm and the first node n1. The gate electrode of the fifth transistor M5 is coupled to the scan line Sn. The fifth transistor M5 is turned on when the scan signal is supplied to the scan line Sn to electrically couple the data line Dm and the first node N1 to each other.

The sixth transistor M6 is coupled between the first power supply ELVDD and the second node N2. The gate electrode of the sixth transistor M6 is coupled to the emission control line En. The sixth transistor M6 is turned off when the emission control signal is supplied to the emission control line En and is turned on when the emission control signal is not supplied.

The first capacitor C1 is coupled between the first node N1 and the first power supply ELVDD. The first capacitor C1 stores a voltage applied to the first node N1.

The second capacitor C2 is coupled between the first node N1 and the third node N3. The second capacitor C2 controls the voltage of the third node N3 to correspond to an amount of change in the voltage of the first node N1.

Figure 3:
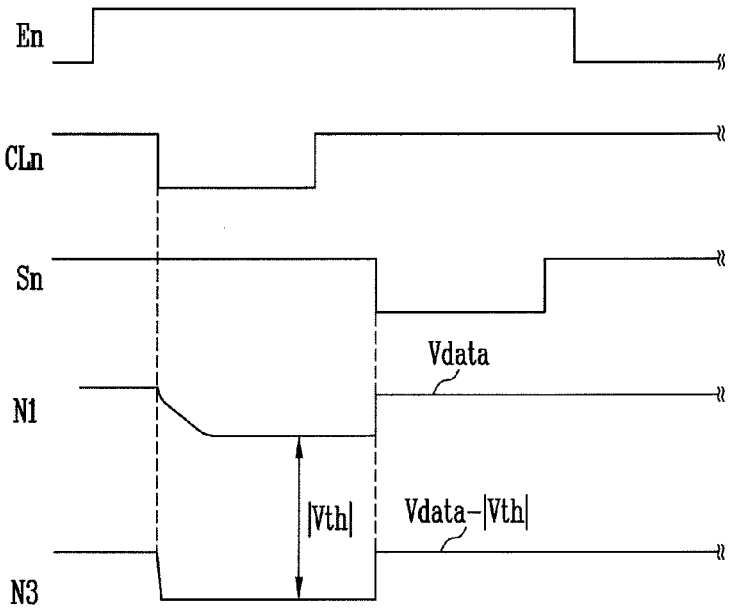
FIG. 3 is a view illustrating an embodiment of a method of driving the pixel of FIG. 2.

FIG. 3 is a view illustrating an embodiment of a method of driving the pixel of FIG. 2.

Referring to FIG. 3, first, the emission control signal is supplied to the emission control line En so that the sixth transistor M6 is turned off. In one embodiment, when the sixth transistor M6 is turned off, electric coupling between the first power supply ELVDD and the second node N2 is blocked. In this case, the OLED is set to be in a non-emission state.

Then, the control signal is supplied to the control line CLn so that the second transistor M2, the third transistor M3, and the fourth transistor M4 are turned on.

When the third transistor M3 is turned on, the voltage of the reference power supply Vref is supplied to the third node N3. When the fourth transistor M4 is turned on, the voltage of the reference power supply Vref is supplied to the anode electrode of the OLED. Here, when the voltage of the reference power supply Vref as a lower voltage than the data signal is applied to the anode electrode of the OLED, the voltage of the reference power supply Vref is set as a voltage at which the OLED may be turned off. For example, the voltage of the reference power supply Vref may be set to be the same as the second power supply ELVSS. Therefore, although the fourth transistor M4 is turned on so that the reference power supply Vref is supplied to the anode electrode of the OLED, the OLED maintains an off state.

When the second transistor M2 is turned on, the first node N1 and the second node N2 are electrically coupled to each other. At this time, the voltage of the first node N1 (that is, the second node N2) is reduced to the voltage obtained by adding the voltage of the reference power supply Vref to the threshold voltage of the first transistor M1. That is, in a period where the control signal is supplied to the control line CLn, the voltage of the first node N1 is set as illustrated in EQUATION 1.

$$V_{N1}=V\text{ref}+|Vth| \quad \text{[EQUATION 1]}$$

In EQUATION 1, Vth represents the threshold voltage of the first transistor M1. After the voltage illustrated in EQUATION 1 is supplied to the first node N1, the scan signal is supplied to the scan line Sn so that the fifth transistor m5 is turned on. When the fifth transistor M5 is turned on, the data signal from the data line Dm is supplied to the first node N1. Then, the voltage of the first node N1 is increased from the voltage of EQUATION 1 to the voltage Vdata of the data signal.

On the other hand, in a period where the scan signal is supplied, the third node N3 is set to be in a floating state. Therefore, the voltage of the third node N3 changes to correspond to the amount of change in the voltage of the first node N1 by coupling of the second capacitor C2. In this case, the amount of change in the voltage of the first node N1 is set as illustrated in EQUATION 2 and the voltage of the third node N3 is set as illustrated in EQUATION 3.

$$\Delta V_{N1}=V\text{data}-(V\text{ref}+|Vth|) \quad \text{[EQUATION 2]}$$

$$V_{N3}=V\text{ref}+V\text{data}-V\text{ref}-|Vth|=V\text{data}-Vth| \quad \text{[EQUATION 3]}$$

That is, when the data signal is supplied to the first node N1, a voltage corresponding to the data signal and the threshold voltage of the first transistor M1 is applied to the third node N3. Then, supply of the emission control signal to the emission control line En is stopped. When the supply of the emission control signal to the emission control line En is stopped, the sixth transistor M6 is turned on. When the sixth transistor M6 is turned on, the first power supply ELVDD and the second node N2 are electrically coupled to each other. In this case, the first transistor M1 controls the amount of current supplied from the first power supply ELVDD to the second power supply ELVSS via the OLED to correspond to the voltage applied to the third node N3. At this time, the amount of current supplied to the OLED is set as illustrated in EQUATION 4.

$$I_{OLED}=K(Vgs-Vth)^2=K(V\text{data}-Vth|-ELVDD-Vth)^2=K(V\text{data}-ELVDD)^2$$

In EQUATION 4, K represents a constant. Referring to EQUATION 4, current that flows to the OLED is determined by the voltage Vdata of the data signal and the first power supply ELVDD. That is, according to one embodiment, it is possible to display an image with desired brightness regardless of the threshold voltage of the first transistor M1.

In a period where the control signal is supplied to the control line CLn, the fifth transistor M5 may maintain a turn off state. That is, the width of the control signal supplied to the control line CLn is controlled regardless of the data signal supplied to the data line Dm so that the threshold voltage may be stably compensated for. Actually, the width of the control signal is set to be no less than 1H so that the threshold voltage of the first transistor M1 may be stably compensated for.

Figure 4:
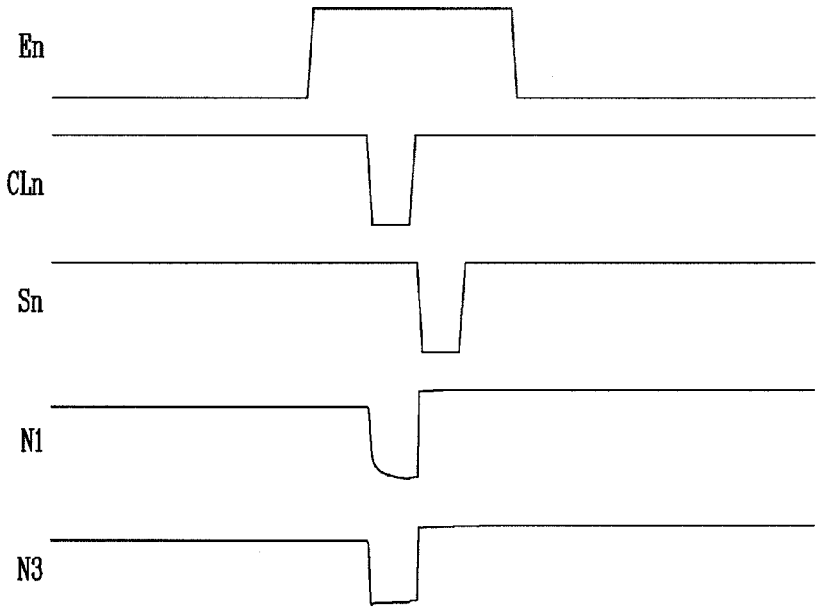
FIGS. 4 and 5 are views illustrating simulation results of the pixel according to an embodiment.
Figure 5:
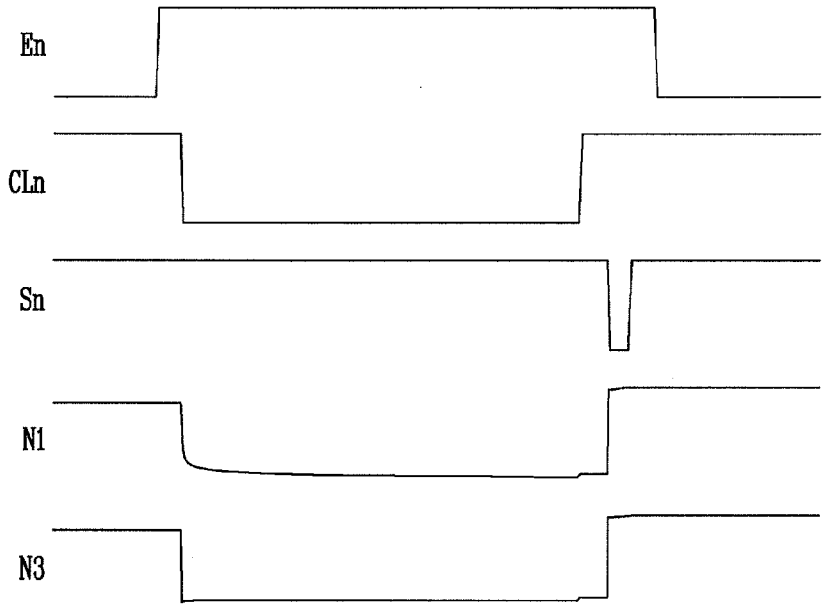

FIGS. 4 and 5 are views illustrating simulation results of the pixel according to one embodiment. In FIG. 4, the control signal is applied in a period of 1H. In FIG. 5, the control signal is applied in a period of 16H.

Referring to FIGS. 4 and 5, the voltage of the third node N3 (or the first node N1) is stably maintained regardless of the width of the control signal supplied to the control line CLn. That is, the voltage of the third node N3 (or the first node N1) is maintained as the voltage corresponding to the threshold voltage in the period where the control signal is supplied regardless of the data signal supplied to the data line Dm so that it is possible to stably compensate for the threshold voltage.

According to at least one of the disclosed embodiments, since the threshold voltage of the driving transistor is compensated for in the period where the control signals are supplied regardless of the scan signals, it is possible to secure the stability of driving. In addition, since the width of the control signals is set to be substantially the same as or larger than the width of the scan signals, it is possible to sufficiently secure the period of compensating for the threshold voltage.

While the above embodiments have been described in connection with the accompanying drawings, it is to be understood that the present disclosure is not limited to the disclosed embodiments, but, on the contrary, is intended to cover various modifications and equivalent arrangements included within the spirit and scope of the appended claims, and equivalents thereof.

What is claimed is:

1. A pixel, comprising:

an organic light emitting diode (OLED);

a first capacitor electrically connected between a first node and a first power supply, wherein the first power supply is operatively connected to a second node;

a first transistor configured to control an amount of current supplied from the first power supply to the OLED to correspond to a voltage applied to a third node, wherein the first transistor comprises a gate electrode;

a second transistor electrically connected between the first and second nodes and configured to be turned on when a control signal is supplied to a control line;

a third transistor operatively connected between the third node and a reference power supply and configured to be turned on when the control signal is supplied, wherein the third transistor comprises a gate electrode, and first and second electrodes, and wherein the first electrode of the third transistor is directly connected to the gate electrode of the first transistor; and a second capacitor electrically connected between the first node and the third node, wherein the pixel further comprises:

a fourth transistor electrically connected between an anode electrode of the OLED and the reference power supply and configured to be turned on when the control signal is supplied; and a fifth transistor electrically connected between a data line and the first node and configured to be turned on when a scan signal is supplied to a scan line.

2. The pixel as claimed in claim 1, wherein the reference power supply is lower than a data signal supplied to the data line.

3. The pixel as claimed in claim 1, wherein the reference power supply is configured to turn off the OLED when the fourth transistor is turned on.

4. The pixel as claimed in claim 1, wherein a turn on period of the fourth transistor does not overlap with a turn on period of the fifth transistor.

5. The pixel as claimed in claim 1, further comprising a sixth transistor electrically connected between the first power supply and the second node and configured to be turned off when an emission control signal is supplied to an emission control line.

6. The pixel as claimed in claim 1, wherein a turn on period of the sixth transistor overlaps with neither the turn on period of the fourth transistor nor the turn on period of the fifth transistor.

7. The pixel as claimed in claim 1, further comprising a sixth transistor connected between the first power supply and the first transistor, wherein a second power supply is directly connected to the OLED, and wherein the first power supply is configured to supply the current to the second power supply via the OLED, when the sixth transistor is turned on.

8. An organic light emitting display, comprising:

a scan driver configured to respectively supply a plurality of scan signals to a plurality of scan lines and respectively supply a plurality of emission control signals to a plurality of emission control lines;

a control line driver configured to respectively supply a plurality of control signals to a plurality of control lines;

a data driver configured to respectively supply a plurality of data signals to a plurality of data lines; and a plurality of pixels positioned at intersections of the scan lines and the data lines, wherein each of the pixels positioned in an ith (i is a natural number) horizontal line comprises:

an organic light emitting diode (OLED);

a first capacitor electrically connected between a first node and a first power supply, wherein the first power supply is operatively connected to a second node;

a first transistor configured to control an amount of current supplied from the first power supply to the OLED to correspond to a voltage applied to a third node, wherein the first transistor comprises a gate electrode;

a second transistor electrically connected between the first and second nodes and configured to be turned on when a control signal is supplied to a control line;

a third transistor operatively connected between the third node and a reference power supply and configured to be turned on when the control signal is supplied, wherein the third transistor comprises a gate electrode, and first and second electrodes, and wherein the first electrode of the third transistor is directly connected to the gate electrode of the first transistor; and a second capacitor electrically connected between the first node and the third node, wherein the organic light emitting display further comprises:

a fourth transistor electrically connected between an anode electrode of the OLED and the reference power supply and configured to be turned on when the control signal is supplied to the ith control line; and a fifth transistor electrically connected between a data line and the first node and configured to be turned on when the scan signal is supplied to the ith scan line.

9. The organic light emitting display as claimed in claim 8, wherein the control line driver is configured to supply a control signal to the ith control line before a scan signal is supplied to an ith scan line.

10. The organic light emitting display as claimed in claim 9, wherein the scan driver is configured to supply an emission control signal to an ith emission control line to overlap with the scan signal supplied to the ith scan line and the control signal supplied to the ith control line.

11. The organic light emitting display as claimed in claim 8, wherein the control signal has a width substantially equal to or larger than the width of the scan signal.

12. The organic light emitting display as claimed in claim 8, wherein the reference power supply is lower than the data signal.

13. The organic light emitting display as claimed in claim 8, wherein the reference power supply is configured to turn off the OLED when the fourth transistor is turned on.

14. The organic light emitting display as claimed in claim 8, further comprising a sixth transistor electrically connected between the first power supply and the second node and configured to be turned off when the emission control signal is supplied to the ith emission control line.

* * * * *